US009282774B2

(12) United States Patent
Martin

(10) Patent No.: US 9,282,774 B2
(45) Date of Patent: Mar. 15, 2016

(54) UNDERGARMENT

(71) Applicant: Amy Martin, Ponte Vedra Beach, FL (US)

(72) Inventor: Amy Martin, Ponte Vedra Beach, FL (US)

( * ) Notice: Subject to any disclaimer, the term of this patent is extended or adjusted under 35 U.S.C. 154(b) by 79 days.

(21) Appl. No.: 13/795,107

(22) Filed: Mar. 12, 2013

(65) Prior Publication Data

US 2014/0259305 A1 Sep. 18, 2014

(51) Int. Cl.

| | |
|---|---|
| ***A41B 9/02*** | (2006.01) |
| ***A41B 9/00*** | (2006.01) |
| *A41B 9/04* | (2006.01) |
| *A41B 9/14* | (2006.01) |

(52) U.S. Cl.

CPC . *A41B 9/001* (2013.01); *A41B 9/02* (2013.01); *A41B 9/04* (2013.01); *A41B 9/14* (2013.01)

(58) Field of Classification Search

CPC ..... A41B 9/002; A41B 9/02; A41B 9/04; A61F 5/40

USPC ..... 602/70; 2/400–406, 67

See application file for complete search history.

(56) References Cited

U.S. PATENT DOCUMENTS

| | | | | | |
|---|---|---|---|---|---|
| D61,135 | S | * | 6/1922 | Golomb | D2/711 |
| 1,421,077 | A | * | 6/1922 | Goldsmith | 602/71 |
| 1,477,565 | A | * | 12/1923 | Jenkins | 602/70 |
| 1,561,888 | A | * | 11/1925 | Stengel | 602/70 |
| 1,742,399 | A | * | 1/1930 | Klein | 602/70 |
| 1,821,962 | A | * | 9/1931 | Callaway | 602/70 |
| 1,920,648 | A | * | 8/1933 | Lane | 602/70 |
| 2,424,462 | A | * | 7/1947 | Hoey | 602/70 |
| 2,454,507 | A | * | 11/1948 | Flaherty | 602/70 |
| 2,524,327 | A | * | 10/1950 | Nelson | 602/70 |
| RE23,334 | E | * | 1/1951 | Montmarquet | 602/70 |
| 3,664,336 | A | * | 5/1972 | Gelston | 602/70 |
| 4,501,024 | A | * | 2/1985 | Russo | 2/67 |
| D283,077 | S | | 3/1986 | Crandall | |
| 4,679,554 | A | * | 7/1987 | Markham | 602/70 |
| 4,894,869 | A | * | 1/1990 | Boll | 2/400 |
| 5,876,395 | A | * | 3/1999 | Hart et al. | 604/393 |
| 6,817,038 | B2 | * | 11/2004 | Blanco | 2/406 |
| D528,739 | S | * | 9/2006 | Williamson | D2/712 |
| D548,927 | S | * | 8/2007 | Perryman | D2/712 |
| D571,533 | S | | 6/2008 | Wiens | |
| D575,929 | S | * | 9/2008 | Dacumos | D2/712 |
| D584,479 | S | | 1/2009 | Jones et al. | |
| 7,716,753 | B2 | * | 5/2010 | Franko | 2/406 |
| D627,932 | S | * | 11/2010 | Mendoza | D29/101.5 |
| D632,055 | S | | 2/2011 | Wynn | |
| D644,412 | S | * | 9/2011 | Reuther | D2/714 |
| D652,610 | S | | 1/2012 | Brantley | |
| 8,117,674 | B2 | | 2/2012 | Warren et al. | |
| D679,007 | S | | 3/2013 | Portash | |
| 2004/0230175 | A1 | | 11/2004 | Rainville-Lonn et al. | |
| 2013/0072888 | A1 | | 3/2013 | Zorin | |

* cited by examiner

*Primary Examiner* — Richale Quinn
(74) *Attorney, Agent, or Firm* — Cantor Colburn LLP

(57) ABSTRACT

An undergarment is provided that does not show through an outer garment. The undergarment includes a flexible waistband. A front panel is coupled to a front portion of the waistband, the front panel having a right corner, an opposing left corner and a center corner disposed between the right corner and left corner, the right corner, left corner and center corner being distally spaced from the waistband. A flexible first strap is coupled between the right corner and the center corner. A flexible second strap is coupled between the right corner and the center corner.

20 Claims, 8 Drawing Sheets

UNDERGARMENT

BACKGROUND OF THE INVENTION

The subject matter disclosed herein relates to an undergarment and in particular to an undergarment that is comfortable to wear without showing lines through pants or other outer garments.

Many different styles of undergarments have been developed that satisfy both function and fashion tastes of wearers. One long standing issue with undergarments is that lines or edges of the undergarments may be visible through an outer garment, especially in the buttock area when thin or closely fitting pants, shorts or skirts are worn. To resolve this problem, different types of undergarments have been proposed. One style of undergarment, commonly referred to as a thong, has a front panel and a center waistband. A center lower corner of the front panel is connected to the center rear of the waistband. Since there is no rear panel, the undergarment does not have an edge that can be seen through an outer garment. While the thong undergarment provides the desired end result, many people do not consider these to be comfortable.

Accordingly, while existing undergarments are suitable for their intended purposes the need for improvement remains, particularly in providing an undergarment that does not show lines through outer garments while is comfortable to wear and also provides full coverage and protection of the central area of the wearer's body.

BRIEF DESCRIPTION OF THE INVENTION

According to one aspect of the invention, an undergarment is provided. The undergarment includes a flexible waistband. A front panel is coupled to a front portion of the waistband, the front panel having a right corner, an opposing left corner and a center corner disposed between the right corner and left corner, the right corner, left corner and center corner being distally spaced from the waistband. A flexible first strap is coupled between the right corner and the center corner. A flexible second strap is coupled between the right corner and the center corner.

According to another aspect of the invention, an undergarment is provided. The undergarment includes a flexible generally circular waistband having a front portion and a rear portion. A front panel is provided having an edge coupled extending about the front portion, the front panel having a right corner, an opposing left corner arranged opposite the waistband, the front panel having a center area extending away from the waistband. A flexible first strap is coupled between the right corner and the center area. A flexible second strap is coupled between the right corner and the center area.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Embodiments of the present invention provide for an undergarment that provides advantages in being comfortable wear without having edges show through outer garments while being worn. Embodiments of the present invention provide still further advantages in providing stomach body shaping functionality in an undergarment that does not show edges through outer garments while being worn.

Figure 1:
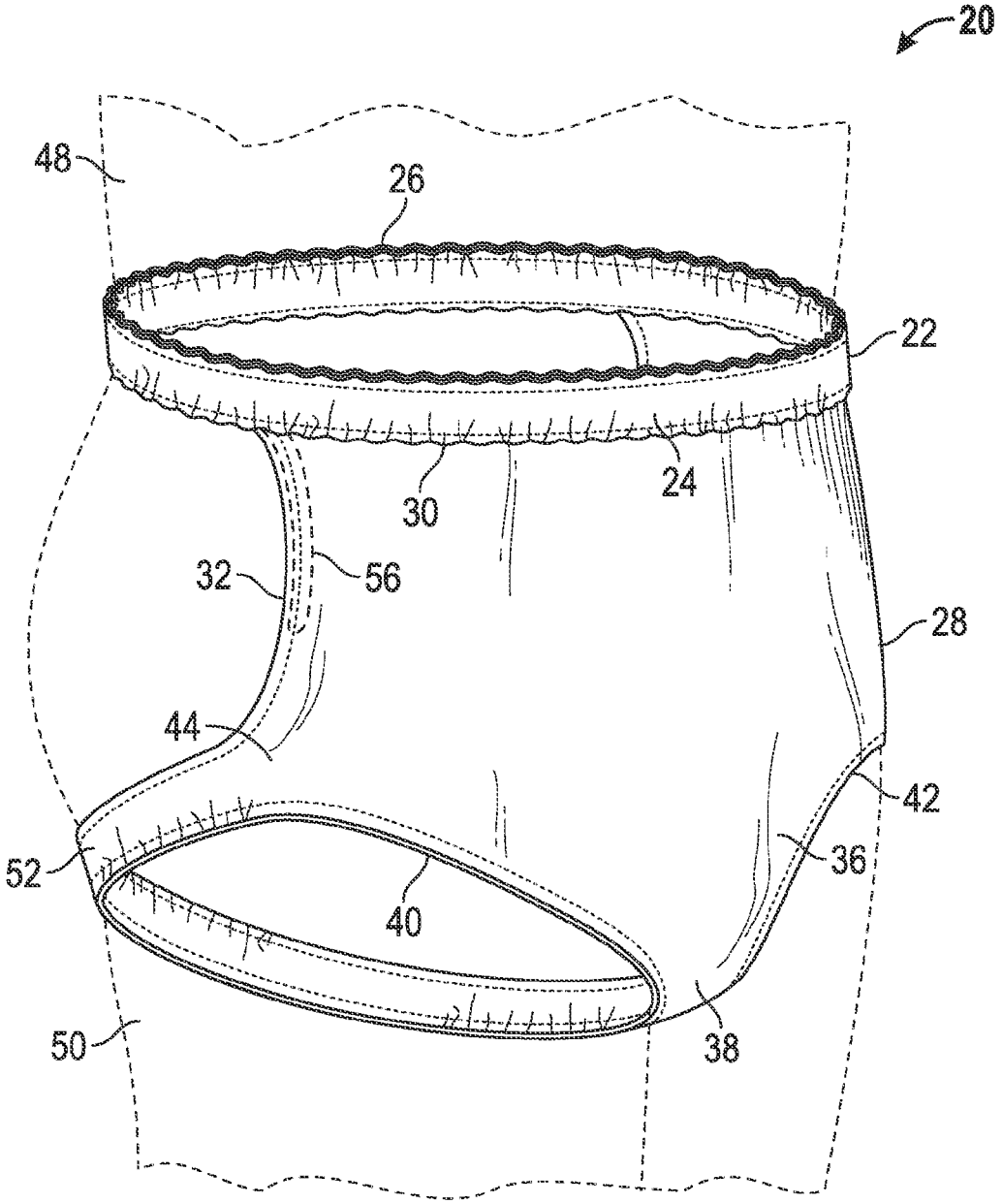
FIG. 1 is a perspective view of an undergarment in accordance with an embodiment of the invention.
Figure 2:
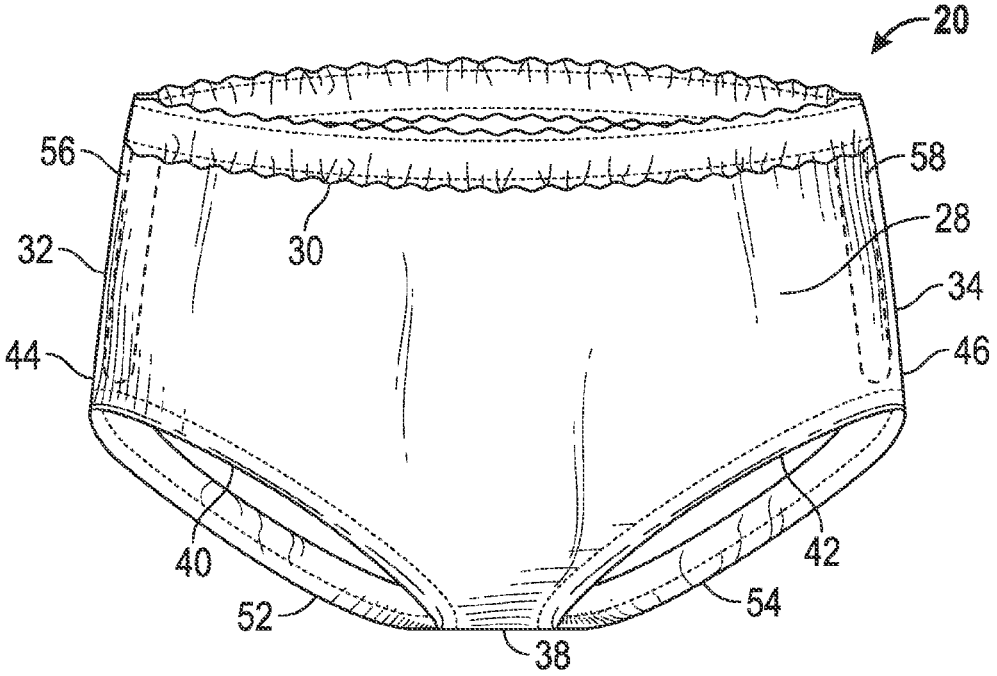
FIG. 2 is a front view of the undergarment of FIG. 1.
Figure 3:
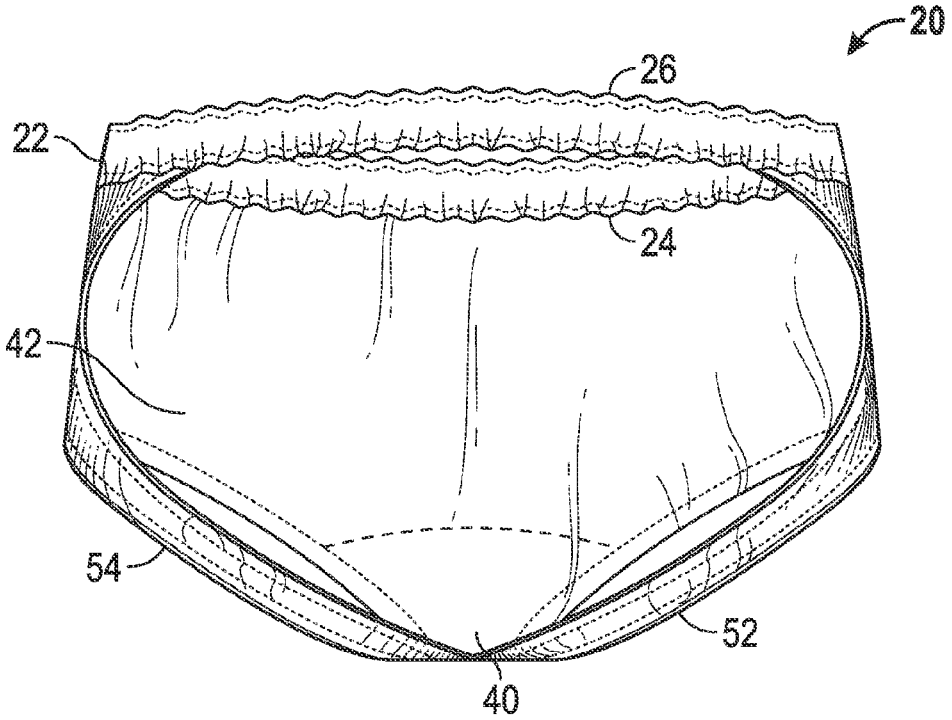
FIG. 3 is a rear view of the undergarment of FIG. 1.
Figure 4:
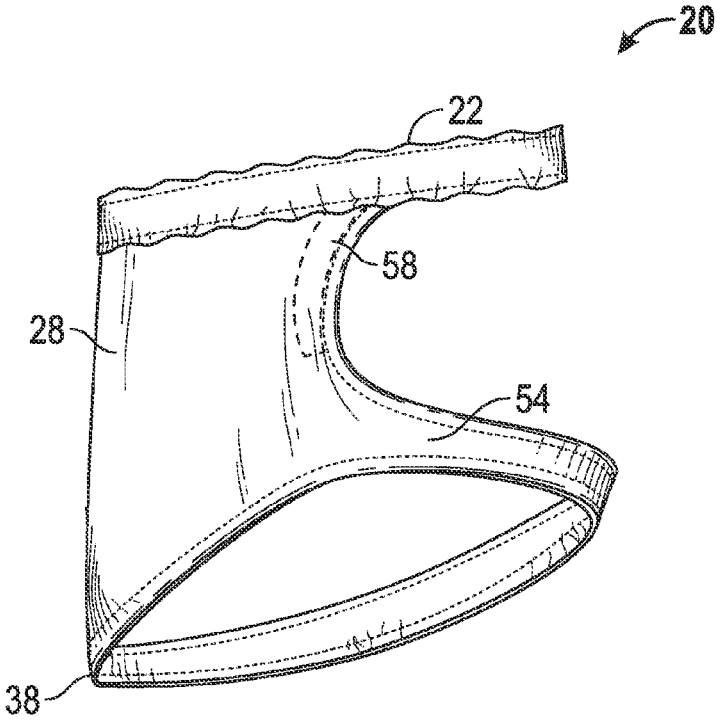
FIG. 4 and FIG. 5 are a side views of the undergarment of FIG. 1.
Figure 5:
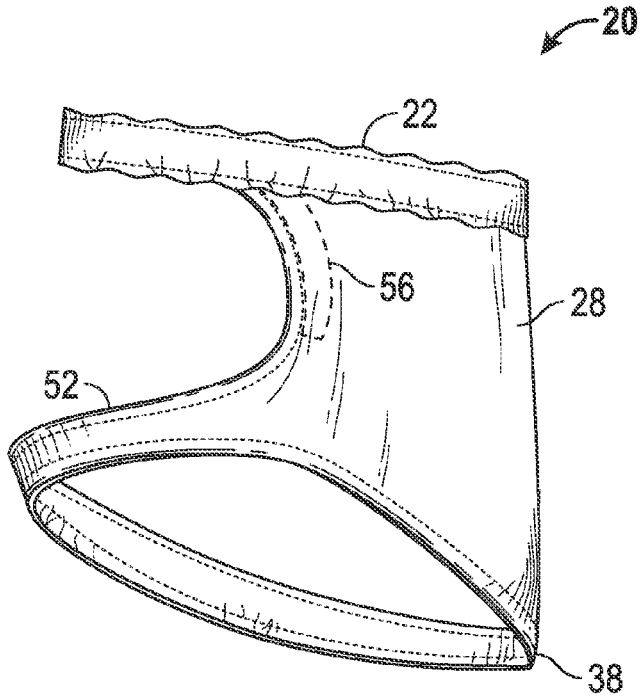
Figure 6:
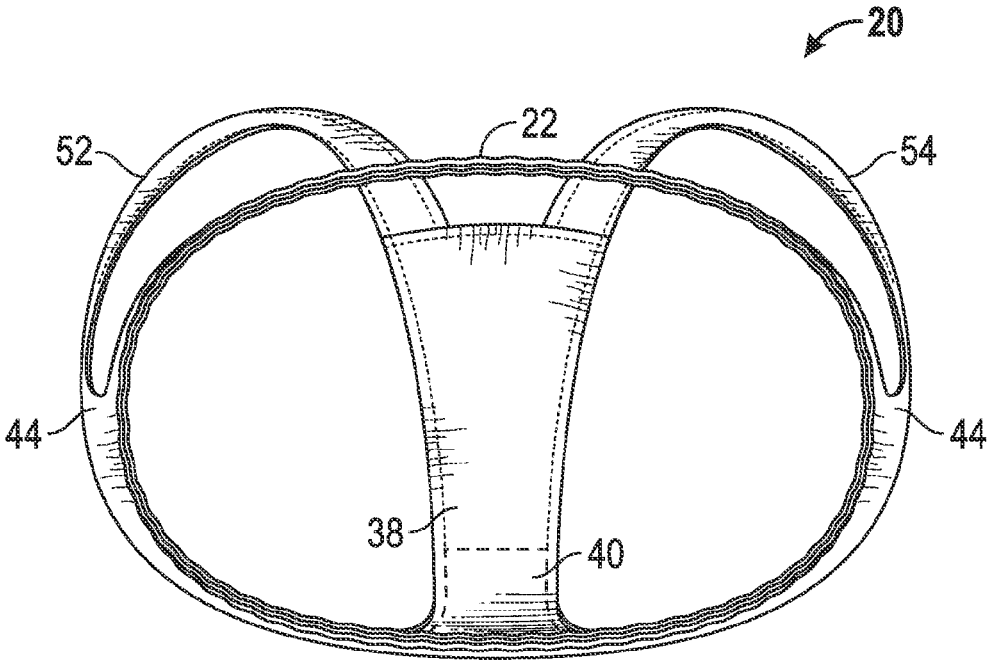
FIG. 6 is a top view of the undergarment of FIG. 1.
Figure 7:
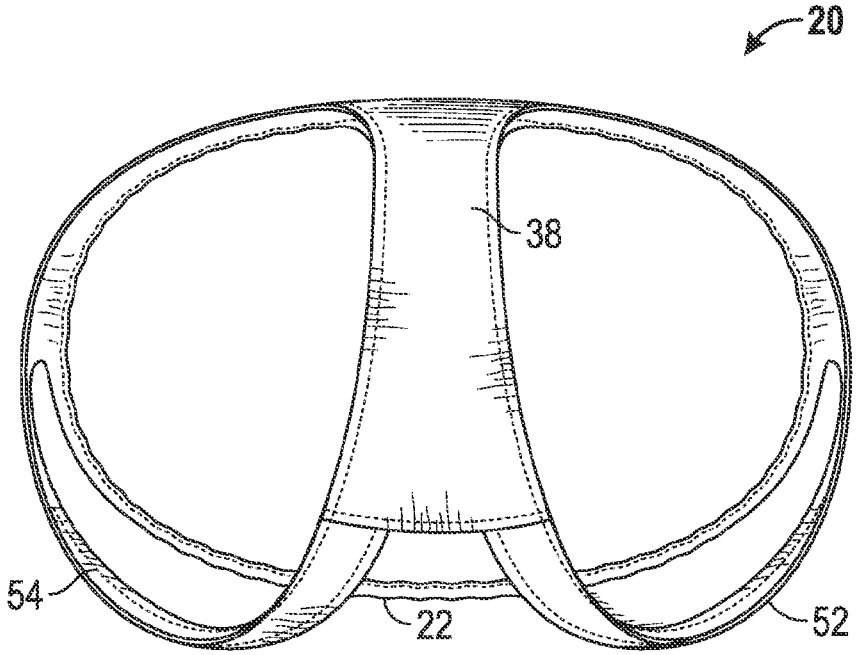
FIG. 7 is a bottom view of the undergarment of FIG. 1.

Referring now to FIGS. 1-7, an undergarment 20 is shown that allows the wearer to wear a wide variety of outer garment clothing without having the edges or lines of the undergarment being seen. The undergarment 20 includes a generally circular or oval waistband 22 having a front portion 24 and a rear portion 26. The waistband 22 is made from an elastic material that allows the waistband 22 to be flexible and conform to the wearer's torso. In one embodiment, the waistband 22 is formed from an elastic member that is covered with a material layer.

A front panel 28 is attached to the front portion 24 along a top edge 30. In the exemplary embodiment, the front panel 28 extends less than or equal to half way around the waist band 22. In one embodiment, the front panel 28 is shaped similar to an irregular pentagon having a pair of sides 32, 34 and a tapered center area 36 defined by a pair of sides 40, 42. The sides 32, 34 may be straight, or curved to contour the wearer's body. In one embodiment the center area is angularly shaped that extends into a center corner 38. In one embodiment, a liner layer 40 may be arranged on the inside surface 42 of the front panel 28. The liner layer 40 may be made from a suitable material, such as 100% cotton for example. The liner layer 40 provides additional protection of the central areas of the wearer's body. In the exemplary embodiment, the front panel 28 is made from a flexible/elastic material, such as a Nylon and spandex/elastane blend. The material of the front panel 28 may be formed to slightly expand when the wear puts on the undergarment 20 to provide a tight, comfortable fit.

In one embodiment, the sides 32, 34 cooperate with the sides 40, 42 to form a corner area 44, 46 at the intersection with the respective adjacent sides. The sides 32, 34 have a length such that the corners 44, 46 are distal from the waistband front portion 24. In one embodiment, the front panel 28 is sized such that the corners 44, 46 are positioned proximate the intersection of the wearer's torso 48 and leg 50, distal from the hip. In other embodiments, the sides 32, 34 are sized to position the corners 44, 46 below the top of the leg 50.

Extending from the right corner 44 is a first strap 52. The first strap 52 is coupled on one end to the right corner 44 and on a second end to the center corner 38. The first strap 52 forms an opening sized to receive a wearer's leg 50. The first strap 52 is made from a flexible material that is configured to expand around the wearer's leg 50 to provide a tight, but comfortable fit. An opposing second strap 54 extends from the corner 46 and also connects with the center corner 38. In the exemplary embodiment, the second strap 54 is constructed identical to (but a mirror image of) the first strap 52. The straps 52, 54 may be formed from the same material as the front panel 28 and be unitary and integral with the front panel 28, or the straps 52, 54 may be formed separately and coupled to the corners 44, 46 and the center corner 38. The straps 52, 54 are arranged on an angle and shaped to extend below the curved portion of the wearer's buttocks. In this way, the undergarment edges that may be visible through the outer garments are concealed by the shape of the wearer's body and the leg material of the outer garment. Further, in an embodiment the sides 32, 34 are arranged to be positioned proximate the location of a seam in an outer garment so as to further conceal the edge and prevent the edge from being seen through the outer garment.

In one embodiment, to maintain a tight fit with the wearer, elastic members 56, 58 may be incorporated into the front panel 28. The elastic members 56, 58 maintain tension between the waistband 22 and the straps 52, 54 to keep the front panel 28 taut and in place as the wearer moves or participates in activities.

Figure 8:
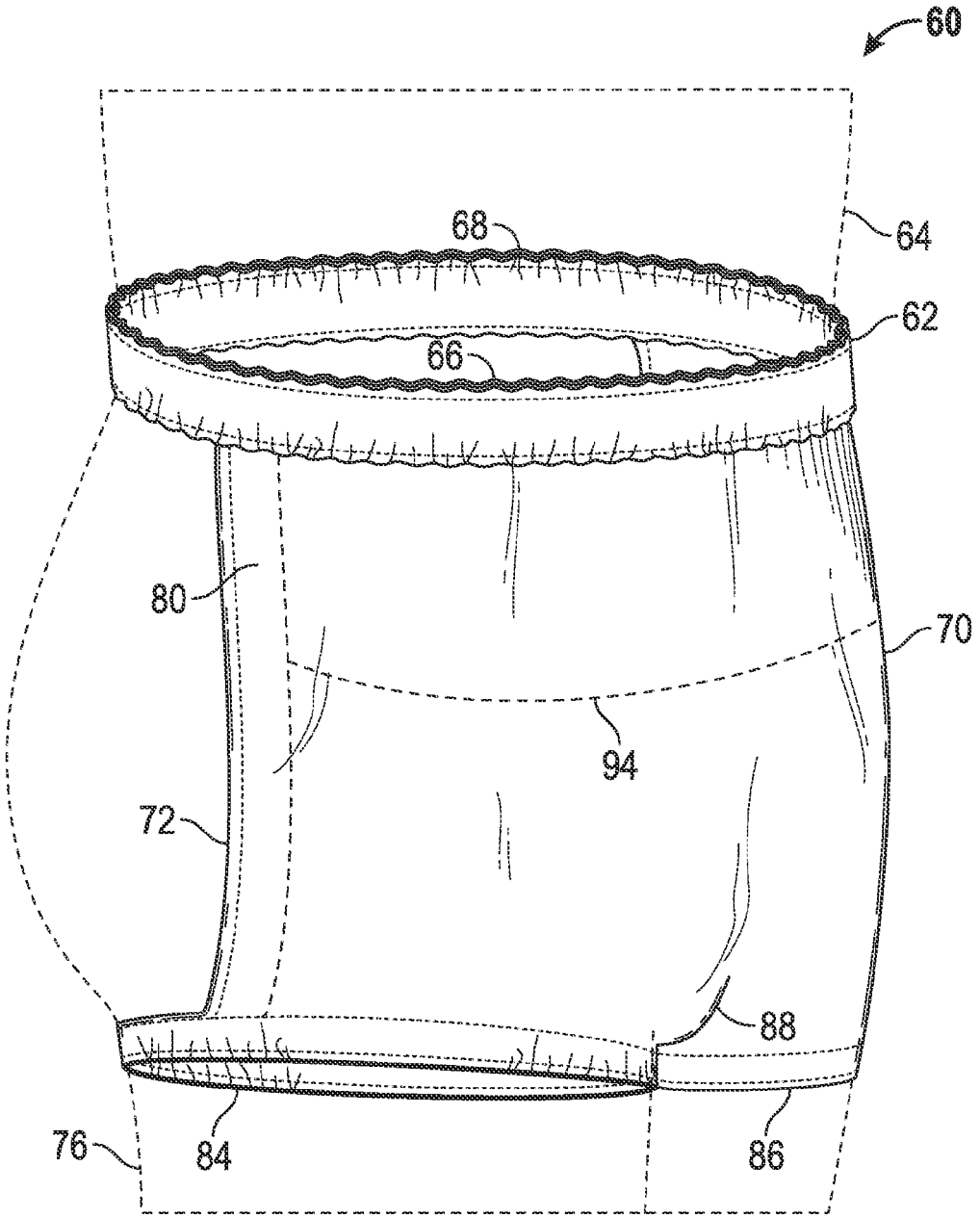
FIG. 8 is a perspective view of an undergarment in accordance with another embodiment of the invention.
Figure 9:
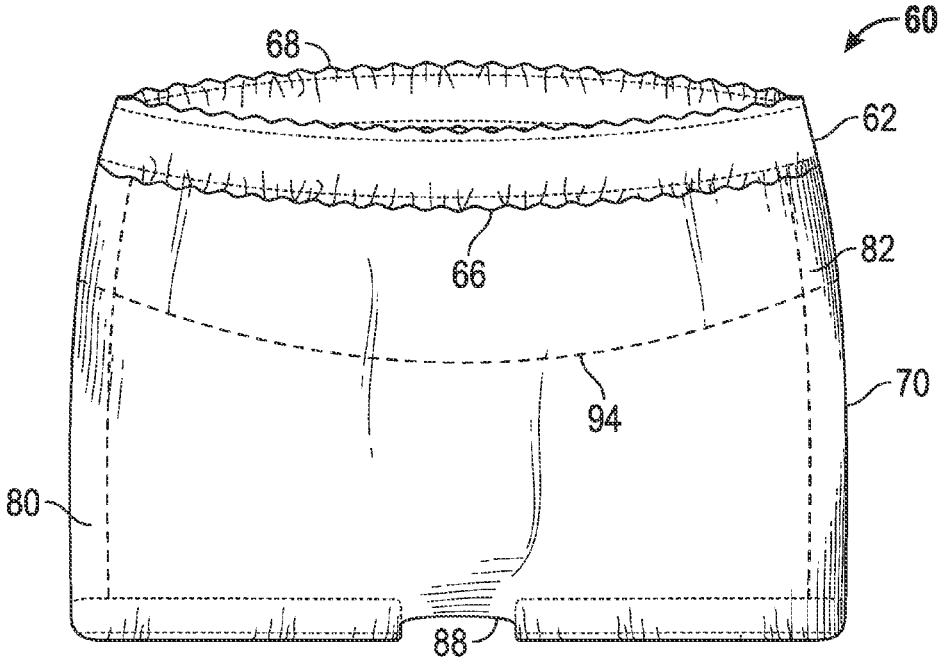
FIG. 9 is a front view of the undergarment of FIG. 8.
Figure 10:
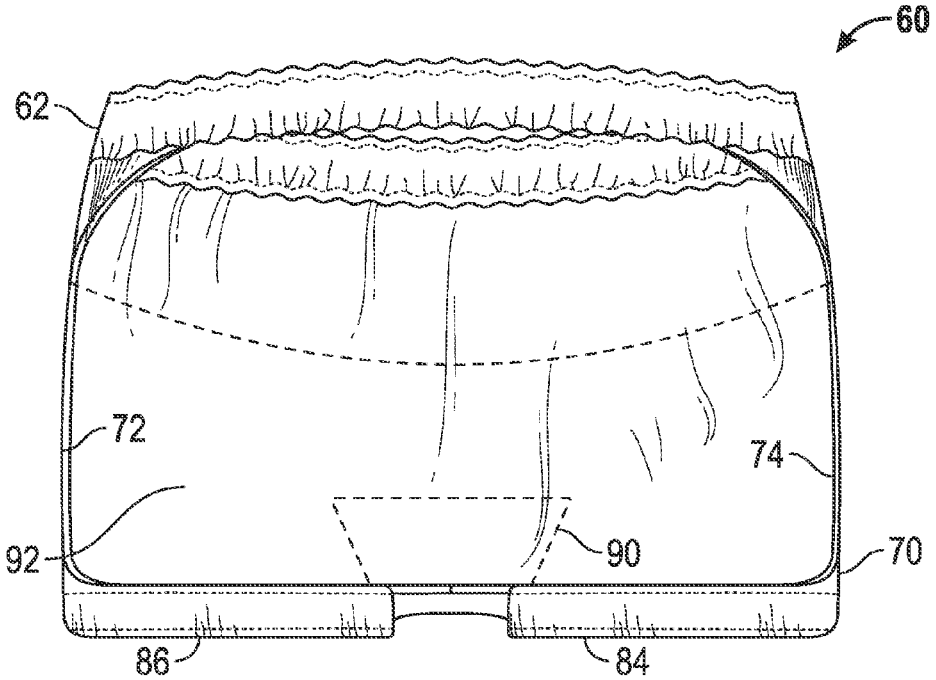
FIG. 10 is a rear view of the undergarment of FIG. 8.
Figure 11:
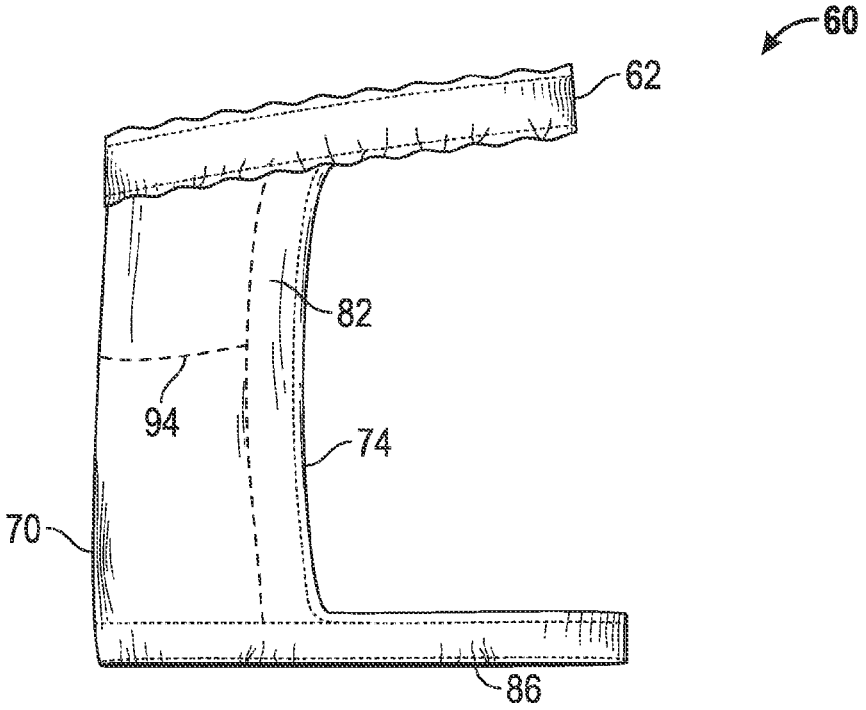
FIG. 11 and FIG. 12 are side views of the undergarment of FIG. 8.
Figure 12:
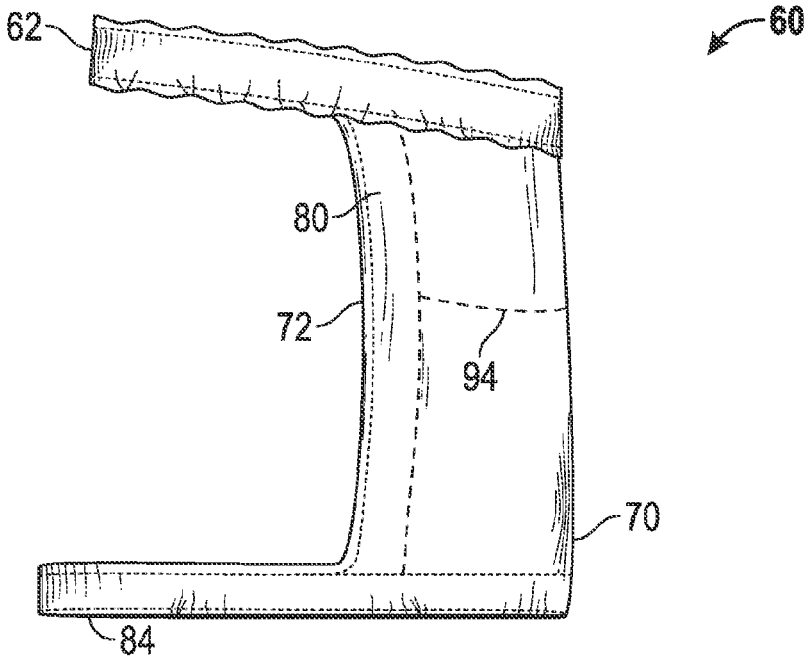
Figure 13:
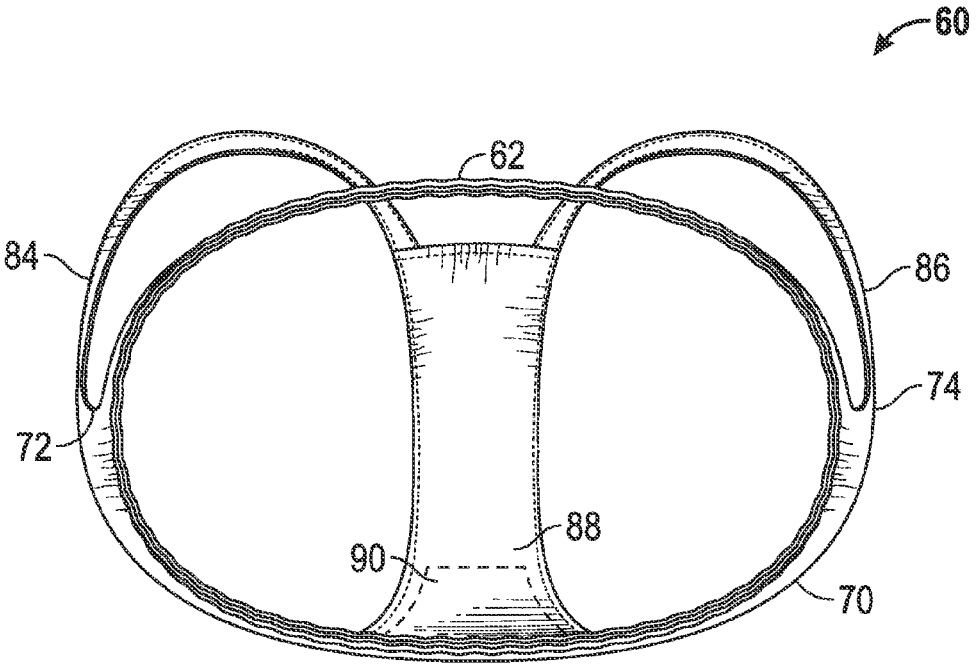
FIG. 13 is a top view of the undergarment of FIG. 8.
Figure 14:
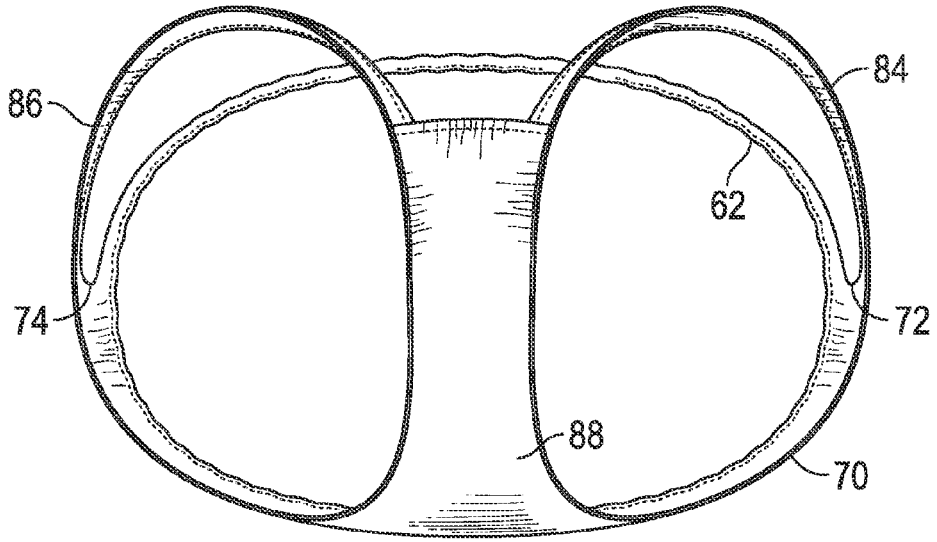
FIG. 14 is a bottom view of the undergarment of FIG. 8.

Referring now to FIGS. 8-14, another embodiment is shown of an undergarment 60 that provides for body shaping. The undergarment 60 includes a waistband 62 that forms a generally circular or oval opening sized to fit about the wearer's torso 64. The waistband 62 includes a front portion 66 and a rear portion 68. The waistband 62 is made from a flexible/elastic material that allows the waistband to conform to the wearer's torso. In one embodiment, the waistband 62 is formed from a first elastic member that is covered by a material layer.

Coupled to the front portion 66 is a front panel 70. The front panel 70 is made from a thin material having some flexibility, such as the aforementioned Nylon and spandex/elastane blend. The front panel 70 is defined by a first side 72 and a second side 74. Each side 72, 74 has a first end adjacent the waistband 62 and is of sufficient length such that the opposing end is located on the upper portion of the wearer's leg 76. An elastic member 80, 82 is arranged along each side 72, 74 to maintain the edges of the front panel 70 taut and conforming with the wearer. In the exemplary embodiment, the front panel 70 extends only partially about the waistband 62. In one embodiment, the sides 72, 74 are arranged to be proximate a seam in an outer garment (e.g. along the wearer's side), to further conceal the edge of the front panel from being seen through the outer garment.

Extending from a corner of each side 72, 74, opposite the waistband 62, is a flexible strap member 84, 86. The strap members 84, 86 connect on an opposite end to a center corner 88 of the front panel 70 to form a generally circular loop that is sized to receive the wearer's leg 76. The straps 84, 86 may be formed from the same material as and be integral and unitary with the front panel 70. In another embodiment, the straps 84, 86 are formed as a continuous loop and the front panel 70 is coupled to the straps along a bottom edge.

In an embodiment, the center corner 88 is closer to the waistband 62 than the strap members 84, 86. It should be appreciated that since the straps 84, 86 are positioned on the top of the wearer's legs, there are no edges that may be seen through an outer garment. It should be appreciated that the strap members 84, 86 are illustrated as being at the top of the wearer's leg for exemplary purposes and the claimed invention should not be so limited. In one embodiment, the straps 84, 86 are positioned further down the wearer's legs. In still another embodiment, the straps 84, 86 are position at the intersection of the wearer's legs and buttocks.

In one embodiment, a liner layer 90 may be arranged on the inside surface 92 of the front panel 70. The liner layer 90 may be made from a suitable material, such as 100% cotton for example.

The front panel 70 further includes a body shaping layer 94 that extends from proximate the waistband 62 towards the straps 84, 86 for a predetermined distance. The body shaping layer 94 provides additional support to the wearer's torso 64 to hold the wearer's abdominal area. In one embodiment, the body shaping layer 94 is less elastic than the material of the front panel 70 such that the body shaping layer 94 does not allow the front panel 70 to stretch as much as it would without the body shaping layer 94. The body shaping layer 94 may have a uniform width across the front panel 70 as shown, or may have a contoured shape (e.g. wider in the center) to achieve the desired support. In the exemplary embodiment, the body shaping layer 94 is formed from an additional layer of the material (e.g. Nylon and spandex/elastane blend) used for the front panel 70, with the plurality of layers being stiffer than a single layer.

It should be appreciated that the undergarment 20 may be sized to be used for either a gender and the claimed invention should not be limited as to a particular gender. In the case of a male undergarment, the front panel 28 may include additional material as when compared relative to a female embodiment. The male undergarment may also include other features, such as but not limited to a slit, opening or flap centrally disposed thereon.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An undergarment comprising:

a flexible waistband having a front portion and a rear portion;

a front panel coupled to the front portion of the waistband, the front panel having a right corner, an opposing left corner and a center corner disposed between the right corner and left corner, the center corner being defined by a lower right side and a lower left side the lower right side and lower left side extending angularly away from the waistband toward the center corner, the center corner arranged vertically opposite the waistband from the right corner and left corner, the right corner and left corner being distal from the waistband and arranged vertically between and closer to the center corner than the waistband;

a flexible first strap coupled between the right corner and the center corner; and a flexible second strap coupled between the left corner and the center corner;

wherein the front panel is only attached to the waistband along the front portion, and wherein the rear portion, sides of the front panel, the first strap and the second strap define a single opening that is configured to expose a wearer's entire buttocks when worn.

2. The undergarment of claim 1 wherein the first strap and second strap are sized, shaped and positioned to extend under a curve of the wearer's buttock and about the top of the wearer's leg when worn.

3. The undergarment of claim 1 wherein the first strap and the second strap are sized, shaped and positioned to extend about a top of the wearer's leg when worn.

4. The undergarment of claim 1 wherein the center corner is tapered and positioned to extend at least partially between the wearer's legs when worn.

5. The undergarment of claim 4 wherein the front panel, first strap and second strap are formed from a single piece of material.

6. The undergarment of claim 4 further comprising a liner layer coupled to the tapered shaped center corner.

7. The undergarment of claim 4 wherein the liner layer is made from cotton.

8. The undergarment of claim 1 further comprising a first elastic member coupled to the front panel between the waistband and the right corner, and a second elastic member coupled to the front panel between the waistband and the left corner.

9. The undergarment of claim 1 further comprising a retainer layer coupled to the front panel proximate the waistband, the retainer layer having an elasticity that is lower than the front panel.

10. An undergarment comprising:

a flexible generally circular waistband having a front portion and a rear portion;

a front panel having an edge coupled extending about the front portion, the front panel attached only to the waistband along the front portion, the front panel having a right side extending between the waistband and a right corner, an opposing left side extending between the waist band and a left corner, the front panel having a center area arranged between the right corner and left corner and defined by a lower right side and a lower left side, the lower right side extending angularly from the right corner away from the waistband to a center corner, the lower left side extending angularly from the left corner away from the waist band to the center corner, the center area extending away from the waistband, wherein the right corner and left corner are vertically disposed between the center area and the waistband and vertically closer to the center area than the waistband;

a flexible first strap coupled between the right corner and the center area; and a flexible second strap coupled between the left corner and the center area, the first strap, second strap, front panel and waistband cooperating to define an opening there between, wherein the first strap and second are configured to extend about the top of a wearer's leg when worn;

wherein the rear portion, sides of the front panel, the first strap and the second strap define a single opening that is configured to expose the wearer's entire buttocks when worn.

11. The undergarment of claim 10 wherein the first strap and second strap are sized, shaped and positioned to extend under the curve of a wearer's buttock when worn.

12. The undergarment of claim 10 wherein the first strap and the second strap are sized, shaped and positioned to extend about a top of the wearer's leg when worn.

13. The undergarment of claim 10 wherein the center area is sized and shaped to extend at least partially between the wearer's legs when worn.

14. The undergarment of claim 13 wherein the front panel, first strap and second strap are formed from a single piece of material.

15. The undergarment of claim 13 further comprising a liner layer coupled to the center area.

16. The undergarment of claim 13 wherein the liner layer is made from cotton.

17. The undergarment of claim 10 further comprising a first elastic member coupled to the front panel between the waistband and the right corner, and a second elastic member coupled to the front panel between the waistband and the left corner.

18. The undergarment of claim 12 further comprising a retainer layer coupled to the front panel proximate the waistband, the retainer layer having an elasticity that is lower than the front panel.

19. The undergarment of claim 1 wherein:

the left corner and right corner are configured to be positioned on an intersection of the wearer's torso and leg, distal from a wearer's hip when worn;

the first strap extends angularly from right corner away from the waistband and is shaped to extend below the curved portion of the wearer's buttocks when worn; and the second strap extends angularly from left corner away from the waistband and is shaped to extend below the curved portion of the wearer's buttocks when worn.

20. The undergarment of claim 10 wherein:

the left corner and right corner are configured to be positioned on an intersection of a wearer's torso and leg, distal from the wearer's hip when worn;

the first strap extends angularly from right corner away from the waistband and is shaped to extend below the curved portion of the wearer's buttocks when worn; and the second strap extends angularly from left corner away from the waistband and is shaped to extend below the curved portion of the wearer's buttocks when worn.

* * * * *